United States Patent [19]

Rubinshtein et al.

[11] 4,368,108

[45] Jan. 11, 1983

[54] PROCESS FOR ELECTROLYTIC RECOVERY OF GALLIUM OR GALLIUM AND VANADIUM FROM ALKALINE LIQUORS RESULTING FROM ALUMINA PRODUCTION

[76] Inventors: Georgy M. Rubinshtein, ulitsa Uralskaya, 51, kv. 3, Kamensk-Uralsky; Sergei P. Yatsenko, ulitsa Lunacharskogo, 182, kv. 65; Valery N. Diev, ulitsa Malysheva, 135, kv. 6, both of Sverdlovsk; Tatyana M. Zlokazova, ulitsa Musy Dzhalilya, 15, korpus 1, kv. 323, Moscow; Eduard S. Fomin, ulitsa Isetskaya, 7, kv. 12, Kamensk-Uralsky; Ruslan N. Moskov, ulitsa Tsvilinga, 2, kv. 4; Anastasia D. Grigorieva, ulitsa Minometchikov, 38, kv. 22, both of Sverdlovsk; Ivan V. Davydov, Nalichnaya ulitsa, 40, korpus 2, kv. 148, Leningrad; Evgeny N. Starkov, ulitsa Uralskaya, 51, kv. 4, Kamensk-Uralsky; Vladimir I. Ovsyannikov, ulitsa Belinskogo, 8, kv. 26, Kamensk-Uralsky; Arnold F. Eremeev, ulitsa Stroitelei, 22, kv. 6, Kamensk-Uralsky; Vladimir N. Lavrenchuk, ulitsa Oktyabrskaya, 75, kv. 6, Kamensk-Uralsky, all of U.S.S.R.

[21] Appl. No.: 232,035

[22] PCT Filed: May 29, 1979

[86] PCT No.: PCT/SU79/00033

§ 371 Date: Jan. 23, 1981

§ 102(e) Date: Jan. 23, 1981

[87] PCT Pub. No.: WO80/02701

PCT Pub. Date: Dec. 11, 1980

[51] Int. Cl.[3] ..... C25C 1/24

[52] U.S. Cl. ..... 204/43 R; 204/105 R

[58] Field of Search ..... 204/105 R, 43 R, 43 Z

[56] References Cited

U.S. PATENT DOCUMENTS 3,966,568 6/1976 Crossley et al. ..... 204/105 R 4,061,551 12/1977 Ivanova et al. ..... 204/105 R

*Primary Examiner*—R. L. Andrews

*Attorney, Agent, or Firm*—Robert E. Burns; Emmanuel J. Lobato; Bruce L. Adams

[57] ABSTRACT

A process for electrolytic recovery of gallium or gallium and vanadium from alkaline liquors resulting from alumina production which comprises electrolysis thereof on solid electrodes at a cathodic current density of from 200 to 1,000 A/m$^2$ voltage of 3.4 to 4.5 V, temperature of 28° to 37° C. in the presence of a metal introduced into said starting liquors prior to the electrolysis in an amount of 1–10 parts by weight relative to the parts by weight of gallium and forming with gallium an alloy which is not passivated under the electrolysis conditions upon a joint electrolytic reduction.

The process for electrolytic recovery of gallium or gallium and vanadium concentrate from alkaline liquors is useful in the production of alumina.

14 Claims, No Drawings

PROCESS FOR ELECTROLYTIC RECOVERY OF GALLIUM OR GALLIUM AND VANADIUM FROM ALKALINE LIQUORS RESULTING FROM ALUMINA PRODUCTION

FIELD OF THE ART

The present invention relates to processes for producing rare and scattered elements and, more specifically, to processes for electrolytic recovery of gallium or gallium and vanadium from alkaline liquors resulting from alumina production.

DESCRIPTION OF THE PRIOR ART

Direct production of gallium from ores is not commercially implemented. Gallium is produced from products of processing bauxites to alumina which contain substantially the following components, percent by mass: alumina 50-60, iron oxides 15-25; silica 2-5; calcium oxide 1-3.

In addition to these components a number of rare elements are present in bauxites, including 1-2 kg/ton of vanadium pentoxide and 0.02-0.07 kg/ton of gallium.

Processing of bauxites by Bayer's method comprises leaching of aluminum oxides contained in the core, by means of a solution of caustic soda. At the same time, gallium passes into the resulting aluminate solution in an amount of about 75 percent by mass in the form of sodium gallate. Upon decomposition of aluminate solutions the predominant amount of gallium remains in the solution, due to the formation of more durable, complex compounds compared to aluminium, (mother aluminate liquor). The mother aluminate liquor, after separation of aluminum hydroxide, is evaporated to a return aluminate liquor and recycled to leach a new portion of bauxite. During circulation these liquors become enriched in gallium.

Under stationary process conditions the gallium concentration in liquors becomes constant and varies within the range of from 0.15 to 0.50 g/l. The concentration value depends on the content of gallium in bauxite, bauxite composition and process technology employed in alumina production.

In a similar manner processing of vanadium is performed in the above-described Bayer's method.

Therefore, for a commercial production of gallium and vanadium from bauxites as the starting materials, use can be made of aluminate liquors.

A process known in the art is for the direct recovery of gallium from alkaline liquors resulting from alumina production on a mercury cathode (Swiss Pat. No. 333,264; 1958; FRG Pat. No. 1,051,827; 1959).

In accordance with this process, the mother aluminate liquor resulting from the Bayer's process is subjected to electrolysis on a liquid mercury cathode and nickel anode. The electrolysis is conducted under the following conditions: anodic current density, 1,000-1,200 A/m$^2$, cathodic current density, 35 to 45 A/m$^2$, duration of electrolysis 24 hours. Under these conditions gallium is reduced on the cathode and diffuses into the bulk of mercury. To facilitate the processes of diffusion and renewal of the cathode surface, an intensive agitation of the liquor and mercury is effected. The electrolysis is stopped when 0.5-1.0% by mass of gallium amalgam is obtained, since solubility of gallium in mercury at the temperature of 50° C. is 1.5% by mass. Gallium amalgam is decomposed by means of a solution of caustic soda at the boiling temperature of the resulting solution in the presence of metallic iron. After carrying out several above-mentioned operations of the amalgam decomposition, the content of gallium in the resulting gallate solution is as high as 30 to 80 g/l. From this solution gallium is recovered in an electrolyzer with a steel/nickel/or liquid gallium cathode.

This process, however, features a low rate of the process of gallium recovery, the use of sophisticated process equipment and large amounts of mercury employed in circulation (up to 3,000 kg in the case of a flat-bottom electrolyzer). Furthermore, mercury is an excellent collector for a number of metals, therefore, the thus-produced gallium is generally strongly contaminated with iron, nickel, lead, copper and molybdenum.

It should also be noted that mercury employed in this prior art process has a high toxicity, while the rate of consumption of mercury in the process is 2 kg per one kg of gallium. Despite severe measures for ensuring safety of operation with mercury, the operating personnel is from time to time withdrawn from the main production shops. Another problem associated with the production of gallium by this process is lack of users of the vanadium slime contaminated with mercury which is simultaneously obtained as a by-product.

To reduce the amount of the employed mercury, Landi (Italy) has proposed an improved design of the electrolyzer, wherein a rotary cathode is used, made in the form of a hollow steel drum with the surface thereof coated with a thin layer of mercury (Aluminio, 1959, 5, 219).

A process for a direct electrochemical recovery of gallium on a solid cathode from alkaline liquors resulting from alumina production is also known in the art (cf. U.S. Pat. No. 3,677,918; 1972).

This process comprises recovery of gallium from said liquors by means of electrolysis using, as the cathode, steel, lead, copper; as the anode use is made of steel, nickel, graphite. The electrolysis in this process is conducted under the following conditions: cathodic current density 1,000 A/m$^2$, voltage 4 V, temperature 60°-80° C.

The electrolysis is conducted after a preliminary effective purification of the liquors from impurities hindering recovery of gallium, namely: vanadium, iron, copper and organic compounds.

Purification from vanadium is conducted by way of reducing soluble pentavalent vanadium compounds to trivalent compounds insoluble in alkaline solutions.

The reduction is effected by means of the addition, into the starting alkaline liquor resulting from alumina production, of sodium hydrosulphite at a temperature of from 60° to 80° C. under vigorous stirring. Reducing said vanadium compounds can also be effected by means of hydrogen which is obtained both by dissolution of granulated aluminum in the aluminate liquor, and electrolysis of alkaline liquors with the use of amalgamated cathode. Satisfactory results are obtained also with the use of membranes made of nonglazed porcelain, which are placed around the electrodes.

Impurities of copper and iron are eliminated from said liquor by reduction thereof with sodium hydrosulphate with a subsequent filtration of the purified liquor; for the removal of organic compounds, the liquor is treated with activated coal at a temperature within the range of from 60° to 80° C. at the rate of 1 g of activated carbon per one liter of the liquor.

This prior art process features the necessity of preliminary effective purification of aluminate liquors from impurities; sophisticated process equipment employed, a low current yield of gallium (0.27%) and a high rate of consumption of electric power (1,700 kW.hr per 1 kg of gallium).

Another known process for electrolytic recovery of gallium from aluminate liquors (cf. French Pat. No. 2,237,991, 1975; British Pat. No. 1,436,260; 1976) comprises recovery of gallium at the cathodic current density of from 20 to 500 $A/m^2$ on a solid cathode manufactured from a metal, whereinto reduced gallium diffuses till its content in the superficial layer of the cathode is equal to 0.1–0.5% by mass. As the cathode material use may be made of tin, lead, indium, zinc or an alloy of tin and lead made as a thin plate with a thickness of from 0.01 to 0.3 mm or as a thick block of said metals. The cathode may be also made of an inert material such as stainless steel coated with said metals to the thickness of from 1 to 50 μm. As the anode use is made of platinum, platinated titanium, stainless steel, nickel, aluminum. The electrolysis is conducted at a temperature within the range of from 25° to 80° C.

Gallium is separated from the cathode by physical methods or by treating the cathode with a molten flux consisting of a molten alkali metal hydroxide at a temperature within the range of from 220° to 800° C.

This prior art process, however, has the following disadvantages:

a low rate of gallium recovery (the process duration is as long as 20 hours) which is associated with diffusion of gallium into the bulk of the substrate metal;

complicated process technology due to the use of consumable cathodes;

the use, as the consumable cathodes, of rarely-available and expensive metals;

complicated and labour-consuming technology of recovering gallium from the cathode material.

DISCLOSURE OF THE INVENTION

It is an object of the present invention to provide a process for electrolytic recovery of gallium or gallium and vanadium from alkaline liquors of alumina production which makes it possible to increase the degree of recovery of gallium or gallium and vanadium and enable the use of starting materials with substantially any content of gallium and vanadium therein.

This object is accomplished by a process for electrolytic recovery of gallium or gallium and vanadium from alkaline liquors resulting from alumina production by way of electrolysis on solid electrodes, wherein, in accordance with the present invention said electrolysis is effected at a cathodic current density of from 200 to 1,000 $A/m^2$, at a voltage of from 3.4 to 4.5 V and temperature within the range of from 28° to 37° C. in the presence of a metal preliminarily introduced into the starting liquors in the amount of 1 to 10 times by weight the amount of gallium; i.e. since the concentration of gallium in the starting liquor is 0.15 to 0.5 g./l., the concentration of the added metal is 0.15 to 5.0 g./l. The metal forms with gallium, upon a joint electrolytic reduction therewith, an alloy in the form of an electrolytic deposit which is not passivated under the electrolysis conditions.

In the process according to the present invention for the recovery of gallium or gallium and vanadium, as the starting alkaline liquors resulting from alumina production use should be made of the mother or return aluminate liquors from Bayer's process; it is preferable to use mixtures of both in a volumetric ratio of from 0.1:1 to 1:0.1 respectively, or return aluminate liquors from the Bayer's process diluted with water in a ratio of from 1:0.1 to 1:0.9 respectively. This makes it possible to make use of liquors more enriched in gallium compared to the mother aluminate liquors and less concentrated in respect of alkalis as compared to the return aluminate liquors.

In order to increase the efficiency of the process for electrolytically recovering gallium, as the alkaline liquors resulting from alumina production it is advisable to use alkaline liquors prepared by way of repulpation with water, at a temperature within the range of from 50° to 100° C., of the soda residue precipitated from the return aluminate liquor from the Bayer's process at a concentration of soda exceeding the equilibrium value thereof, followed by filtration of the resulting liquor.

In accordance with the present invention, as a metal preliminarily introduced into the starting liquors use is preferably made of zinc, lead and tin.

Said metals, owing to their electrochemical properties, form residues upon electrolysis which contain gallium or gallium and vanadium.

In the process according to the present invention, upon electrolysis of alkaline liquors resulting from alumina production use is made of DC, pulsating current, reversible current, as well as various combinations thereof. This technique makes it possible to substantially increase the degree of recovery and current yield of gallium or gallium and vanadium, increase the content of these components in the electrolytic deposit, as well as reduce the rate of power consumption.

In order to eliminate contamination of the starting alkaline liquors resulting from alumina production and contamination of the desired products (gallium or gallium and vanadium), in accordance with the present invention as the electrodes use should be made of metals resistant in alkaline media, i.e. steel, nickel, titanium. Said metals possess a satisfactory adherence to the electrolytic deposit containing the metal preliminarily introduced into the starting liquor and gallium, or gallium and vanadium.

In the process according to the present invention, for increasing the efficiency of the electrolytic recovery of gallium or gallium and vanadium, use is made of water-cooled cathodes.

In the case where the starting alkaline liquor resulting from alumina production contains polyvalent sulphur compounds, it is advisable, for combining said sulphur compounds, to charge said preliminarily introduced metal, apart from the above-specified amount thereof, into the liquor prior to the electrolysis in an additional amount stoichiometric with respect to the content of polyvalent sulphur compounds in the starting liquor. This enables an additional purification of alkaline liquors resulting from alumina production, improves the quality of alumina and makes use of bauxites with an increased content of pyrite minerals.

According to the process of the present invention, it is advisable that the electrolysis be effected till a residual concentration of the metal preliminarily introduced into the starting liquors resulting from alumina production equals 0.020–0.005 g/l. This makes it possible to minimize contamination of alkaline liquors resulting from alumina production with foreign impurities.

The process according to the present invention is simple, effective and integrally combined with the production of alumina; it makes possible the production of gallium or gallium and vanadium directly from alkaline liquors resulting from alumina production of substantially any composition, and the use of starting materials with both high and low content of gallium, vanadium, pyrite and carbonate minerals.

The process according to the present invention makes it possible to eliminate the preliminary purification of alkaline liquors resulting from alumina production from impurities hindering electrolysis, such as vanadium, copper, iron, polyvalent sulphur compounds and organic compounds; eliminates the use and consumption of toxic (mercury) and expensive (tin, indium, lead) materials; employs standard electrolyzers, thus making it possible to combine recovery of gallium or gallium and vanadium with a simultaneous purification of alkaline liquors from harmful impurities (iron, lead, copper, titanium, polyvalent sulphur compounds).

The process according to the present invention can be easily automated; it reduces capital expenses for the production of gallium. The repay period of a plant producing annually 10 tons of gallium is not longer than one year.

BEST MODE OF CARRYING OUT THE INVENTION

The process according to the present invention is effected in the following manner.

As the starting alkaline liquors resulting from alumina production use is made of the liquors obtained in processing of bauxites by the sintering method or Bayer's method.

It is preferable to use aluminate liquors resulting from Bayer's process owing to a higher content of gallium therein.

The mother liquors produced in processing of bauxites according to Bayer contain, on the average, the following components in the amounts specified hereinbelow, g/l: sodium oxide—130–180; alumina 60–80; silica 0.3–0.6; iron oxide 0.004–0.006; organic compounds—1.5–2.0 (as calculated for oxygen by potassium permanganate), total sulphur 2.5–3.5 including sulphide sulphur 0.5–0.8, thiosulphate sulphur 1.0–1.2; sulphite sulphur 0.2–0.4, sulphate sulphur 0.8–1.1.

The return aluminate liquors contain, on the average, g/l: sodium oxide 260–320; alumina—120–160; silica—0.6–1.2; iron oxide—0.01–0.015; organic compounds—3.0–4.0; total sulphur—5.0–7.0 including sulphide sulphur 1.0–1.6; thiosulphate sulphur 2.0–2.4; sulphite sulphur —0.4–0.8; sulphate sulphur—1.6–2.2.

The concentration of gallium and vanadium in mother aluminate liquors is respectively 0.15–0.25 and 0.16–0.27 g/l; in return aluminate liquors the concentration of gallium and vanadium is respectively 0.30–0.50 and 0.32–0.56 g/l.

For electrolytic recovery of gallium or gallium and vanadium use can be made of both above-specified and other liquors. In both cases recovery of gallium into the electrolytic deposit within 4 hours of electrolysis is 40 to 80%, that of vanadium is 10 to 40%. It has been found that best results of recovery of gallium or gallium and vanadium are obtained with the use of a mixture of said mother and return aluminate liquors in a volumetric ratio of 0.1–1:1–0.1 respectively, or with the use of the return aluminate liquor from Bayer's process diluted with water in a volume ratio of 1:0.1–0.9 respectively. Electrolysis of the return aluminate liquor per se is hindered and economically inefficient due to a high concentration of sodium oxide therein and, consequently, increased viscosity and electric resistance of this liquor, this causing a considerable foam-formation and voltage rise in the electrolyzer.

In order to increase the content of gallium in the liquor and lower the concentration of sodium oxide therein, use is made of liquors prepared by way of repulpation, with water at a temperature within the range of from 50° to 100° C., of the residue from the soda precipitation of the return aluminate liquor resulting from Bayer's process at a concentration of soda exceeding the equilibrium amount thereof, followed by filtration of the resulting liquor.

Prior to electrolysis, into any of the above-specified liquors an amount of metal is added in a 1–10 parts by weight relative to gallium, which metal forms with gallium an alloy which is not passivated under electrolysis conditions, upon a joint electrolytic reduction. Furthermore, said metal has the structure and parameters of crystal lattice similar to those of gallium, as well as the recovery potential approaching that of gallium. As such metal, use may be made, for example, of zinc, lead, tin which is introduced into hot alkaline aluminate liquors resulting from alumina production either per se or in the form of an oxide, an inorganic salt soluble in said liquors. It is preferable to use zinc which is not passivated upon electrolysis, has a high overtension relative to hydrogen (0.7 V), a recovery potential close to that of gallium (i.e. −1,220 V for Ga and −1.216 V for Zn), as well as similar structure and parameters of crystal lattice. During electrolysis, zinc, while being deposited on a solid cathode, renews its surface, whereby the deposition of gallium or gallium and vanadium occurs on the zinc cathode. These factors facilitate the process of reduction of ions of gallate and vanadate on the cathode.

In the case where in the starting alkaline liquor resulting from alumina production, polyvalent sulphur compounds are present, for combining the latter, into said liquor, prior to electrolysis, an additional portion of the metal forming an alloy with gallium, non-passivating under electrolysis conditions, is added in the stoichiometric amount relative to the polyvalent sulphur compounds. In doing so, the decomposition of thiosulphate sulphur compounds during electrolysis to compounds of sulphide sulphur is taken into account and sulphate sulphur.

The alkaline liquor resulting from alumina production and containing said added metal in an amount of 1–10 parts by weight relative to gallium is subjected to electrolysis on solid electrodes under the following conditions:

cathodic current density of from 200 to 1,000 A/m$^2$; voltage 3.4 to 4.5 V; process temperature of from 28° to 37° C. As the electrode material use is made of metals resistant in alkaline media, namely: steel, nickel, titanium.

It is advisable that the cathode be cooled with water in order to increase the electrolysis temperature due to a lower temperature of the cathode surface and increased temperature within the bulk of the solution. As a result, the liquor viscosity is lowered and the voltage across the electrolyzer is decreased.

To intensify the process, increase the current yield of gallium or gallium and vanadium, the electrolysis is conducted using direct current, pulsating and reversing current, as well as various combinations of said currents.

The resulting electrolytic deposit is removed from the cathode by any conventional method such as mechanical or chemical ones, while the liquor with the residual concentration of the introduced metal of from 0.050 to 0.005 g/l is recycled to the production of alumina.

Gallium or gallium and vanadium are recovered from the resulting electrolytic deposit by any conventional method such as vacuum-thermal treatment. Furthermore, it is possible to recover gallium or gallium and vanadium by dissolution of the electrolytic deposit in acids or alkalis. Thereafter, gallium is recovered from the resulting solutions electrolytically, while vanadium remains in the solution as a slime of vanadium concentrate and is then filtered-off. Gallium produced by this process contains, as the principal impurity, 2 to 6% by mass of the metal preliminarily added to the liquor for electrolysis.

Production of metallic gallium containing the above-mentioned amount of the metal preliminarily added to the starting liquor, for example zinc, facilitates the production of gallium having much smaller amounts of other impurities. It is known that in the case of the presence of zinc in gallium in the above-specified amount, the activity of gallium is lowered, whereby the solubility therein of other impurities is substantially reduced. The removal of zinc by conventional methods such as acid treatment or vacuum-thermal treatment is performed without any trouble.

For a better understanding of the present invention, some specific Examples illustrating the process of recovery of gallium or gallium and vanadium are given hereinbelow.

EXAMPLE 1

A return aluminate liquor resulting from Bayer's process in the amount of 48 l having the following composition as to the content of the main components, g/l; sodium oxide 310; alumina—138; silica—0.9; iron oxide—0.019; organic compounds—3.89; gallium—0.43; vanadium—0.35, is diluted with 12 l of water in the volume ratio of 1:0.25. Then into the liquor heated to the temperature of 90° C. there are added 112 g of zinc oxide under stirring. The resulting liquor having the following composition, g/l: sodium oxide—250; alumina—112; silica—0.72, iron oxide—0.008; organic compounds—3.14; gallium—0.35; vanadium—0.28 and zinc—1.5 (4.3-fold relative to gallium) is fed into the electrolyzer with a working volume of 60 liters. Electrolysis is carried out using direct current under the following conditions: cathodic current density 650 A/m$^2$, voltage 3.8 V, temperature 32° C. The material of anodes—steel IX18H9T, the material of cathodes-nickel.

After 4 hours of electrolysis the following metals are recovered from the liquor, in percent of the starting amounts: gallium—57; vanadium—20; zinc—90.

The thus-produced electrolytic deposit is removed from the cathode mechanically, while the liquor, after electrolysis with the residual concentration of zinc of 0.02 g/l is recycled to the production of alumina.

The electrolytic residue is washed with water to remove sodium oxide and other soluble impurities, dried and subjected to vacuum-thermal sublimation to remove zinc. The residue obtained after the vacuum-thermal sublimation contains gallium and vanadium; this residue is dissolved in 3 liters of a hot solution of caustic soda with a concentration of 150 g/l as calculated for sodium oxide. The vanadium concentrate is precipitated and the precipitate is separated by filtration, while the solution containing gallium in the amount of 4 g/l is subjected to electrolysis on a nickel cathode at a cathodic current density of 1,200 A/m$^2$ and a temperature of 60° C.

The total amount of the recovered gallium is 11.4 g; that of vanadium concentrate is 8.1 g.

The thus-produced metal contains, percent by mass: gallium—96.997; zinc—3.0; lead—$1.10^{-3}$; copper—$1.10^{-3}$, aluminium—$1.10^{-3}$; and other impurities are not detected. The vanadium concentrate contains, percent by mass: vanadium pentoxide—84.1; sodium oxide—10.0; silica—2.0; gallium—0.2; zinc—3.7.

After treatment of the resulting metallic gallium with hydrochloric acid diluted with water in the ratio of 1:2 (by volume) at the temperature of 60° C., the content of gallium in the product is 99.998% by mass.

EXAMPLE 2

The return aluminate liquor resulting from Bayer's process in the amount of 40 l having the composition described in the foregoing Example 1 is mixed with 20 l of the mother aluminate liquor resulting also from Bayer's process and having the following composition as to the content of the main components, g/l: sodium oxide 173, alumina—75.1; silica—0.42; iron oxide—0.005; organic compounds—1.94; gallium—0.19; vanadium—0.17. The volume ratio of the liquors is 1:0.5. Then, into the resulting liquor 110 g of zinc oxide are added using the procedure described in the foregoing Example 1. The resulting liquor having the following composition, g/l: sodium oxide—264; alumina—117; silica—0.74; iron oxide—0.008; organic compounds—3.24; gallium—0.35; vanadium—0.29 and zinc—1.5 (4.3:fold relative to gallium) is subjected to electrolysis in a manner similar to that of Example 1, except that the cathodic current density is equal to 1,000 A/m$^2$ at the voltage of 4.1 V.

After 4 hours of electrolysis the following metals are recovered, in percentage of their starting amounts: gallium—63; vanadium—28; zinc—96.

The resulting electrolytic deposit is removed from the cathodes and processed to gallium and vanadium concentrate in a manner similar to that of Example 1 hereinabove.

The total amount of the recovered gallium is 12.5 g; that of vanadium concentrate is 10.1 g.

The composition of the resulting products is similar to that indicated in Example 1.

EXAMPLE 3

The return and mother liquors resulting from Bayer's process having compositions according to Examples 1 and 2 respectively are mixed in the volume ratio of 0.1:0.9. Thereafter, into 60 l of the thus-prepared liquor 67.5 g of zinc oxide are introduced by the method described in Example 1. The resulting solution having the following composition, g/l: sodium oxide—187; alumina—81.3; silica—0.47; iron oxide—0.006, organic compounds—2.13; gallium—0.21; vanadium—0.19 and zinc—0.9 (4.3-fold relative to gallium) is subjected to electrolysis in a manner similar to that described in Example 1 hereinbefore.

After 4 hours of electrolysis the following metals are recovered, in percentage of their starting amounts: gallium—48; vanadium—15; zinc—96.

The total amount of the recovered gallium is 5.7 g; that of vanadium concentrate is 3.5 g.

The composition of the resulting products is similar to that of Example 1.

EXAMPLE 4

Into 60 l of a liquor prepared in a manner similar to that described in Example 3 there are introduced 109 g of zinc oxide. The resulting solution of the following composition, g/l: 187—sodium oxide; alumina 81.3; silica—0.47; iron oxide—0.006; organic compounds—2.13; gallium—0.21; vanadium—0.19; zinc—1.47 (7-fold relative to gallium) is subjected to electrolysis like in Example 1.

After 4 hours of electrolysis the following metals are recovered, in percentage of their initial amounts: gallium—65; vanadium—37; zinc—97.

The thus-produced electrolytic deposit is removed from the cathodes and processed to gallium and vanadium concentrate in a manner similar to that of Example 1.

The total amount of the recovered gallium is 7.8 g; that of vanadium concentrate is 8.5 g.

The composition of the resulting products is similar to that described in Example 1 hereinbefore.

EXAMPLE 5

The liquor prepared in a manner similar to that described in Example 1 and having composition as indicated in the same Example 1, except that the content of zinc is 3.5 g/l (10-fold relative to gallium) is subjected to electrolysis following the procedure of Example 1.

After 4 hours of electrolysis the following metals are recovered, in percentage of their initial amounts: gallium—38; vanadium—10; zinc—90.

The resulting electrolytic deposit is removed from the cathodes and processed to gallium and vanadium concentrate in a manner similar to that of Example 1.

The total amount of the recovered gallium is 7.6 g; that of vanadium concentrate is 5.8 g.

The composition of the resulting products is similar to that described in Example 1.

EXAMPLE 6

The return and mother liquors resulting from Bayer's process having the compositions indicated in Examples 1 and 2 respectively are mixed in the volume ratio of 0.9:0.1. Then to 60 l of the thus-prepared liquor 127 g of zinc oxide are added using the method described in Example 1 hereinbefore. The resulting liquor having the following composition, g/l: sodium oxide—296; alumina—132; silica—0.85; iron oxide—0.018; organic compounds—3.69; gallium—0.41; vanadium—0.33 and zinc—1.77 (4.3-time relative to gallium) is subjected to electrolysis as in Example 1, but at the voltage of 4.5 V.

After 4 hours of electrolysis the following metals are recovered, in percentage of their starting amounts; gallium—40; vanadium—13; zinc—92.

The resulting electrolytic deposit is removed from the cathodes and processed to gallium and vanadium concentrate as described in Example 1.

The total amount of the recovered gallium is 9.3 g; that of vanadium concentrate is 5.4 g.

The composition of the resulting products is similar to that described in Example 1 hereinbefore.

EXAMPLE 7

The residue obtained after settling and filtration of the return aluminate liquor resulting from Bayer's process is repulped with water for 8 hours at the temperature of 60° C. Then the resulting solution is filtered-off to separate it from the residue insoluble in water. The resulting filtrate has the following composition, g/l: sodium oxide—246; alumina—92; gallium—0.4; iron oxide—0.04. Into this filtrate taken in the amount of 60 liters 1.5 g/l of zinc are introduced as described in Example 1. Afterwards, electrolysis is conducted using DC under the following conditions: cathodic current density of 400 A/m$^2$; voltage 3.4 V; temperature 30° C. The material of anodes is steel 1Z18H9T; material of the cathodes is nickel.

After 4 hours of electrolysis the following metals are recovered, in percentage of their initial amounts: gallium—75; zinc—98.

The removal of the residue and processing thereof to metallic gallium is effected as in Example 1.

The total amount of gallium recovered is 18 g.

The composition of the resulting metallic gallium is similar to that indicated in Example 1 hereinbefore.

EXAMPLE 8

The return aluminate liquor resulting from Bayer's process and having the composition according to Example 1, but containing no vanadium is diluted with water in the volume ratio of 1:0.32. Then to 60 l of the solution heated to the temperature of 100° C. 45 g of lead oxide are added under stirring. The resulting liquor having the following composition, g/l: sodium oxide—250; alumina—112, silica—0.72; iron oxide—0.008; organic compounds—3.14; gallium—0.35; and lead—0.7 (2-fold excess relative to gallium) is subjected to electrolysis as in Example 1. After 4 hours of the electrolysis the following metals are recovered from the liquor, percentage of their initial amounts: gallium—69; lead—95. The resulting electrolytic deposit is removed from the cathode mechanically, while the liquor after electrolysis with the residual lead concentration of 0.005 g/l is recycled to the production of alumina.

The electrolytic deposit is dissolved in 3 l of sulphuric acid with the concentration of 210 g/l heated to the temperature of 60° C. The lead-containing precipitate is separated by filtration and the solution is neutralized with a 5% solution of ammonia to precipitate gallium hydroxide. The latter is dissolved in 3 l of a solution of caustic soda with the concentration of 150 g/l as calculated for sodium oxide. The resulting solution with the concentration of gallium of 4.4 g/l is subjected to electrolysis in a manner similar to that described in Example 1.

The total amount of recovered gallium is 12.5 g.

The resulting metal contains gallium in the amount of 99.98% by mass.

EXAMPLE 9

To 60 liters of the liquor prepared as described in Example 1, but containing no vanadium, 112 g of zinc oxide are added. The resulting liquor having the following composition, g/l: sodium oxide 250; alumina 112; silica—0.72; iron oxide—0.008; organic compounds—3.14 gallium—0.35 and zinc—1.5 (4.3-time relative to gallium) is subjected to electrolysis as in Example 1, but with the cathodic current density of 300 A/m$^2$ at the voltage of 3.4 V.

After 4 hours of electrolysis the following metals are recovered, in percentage of their initial amounts: gallium—46; zinc—95. The resulting electrolytic deposit is removed from the cathodes and processed to gallium in a manner similar to that described in Example 1.

The total amount of recovered gallium is 9.1 g. The composition of the resulting metallic gallium is similar to that indicated in Example 1 hereinbefore.

EXAMPLE 10

The return and mother liquors resulting from Bayer's process having compositions indicated in Examples 1 and 2 respectively but containing no vanadium are mixed in the volume ratio of 0.56:0.44. Thereafter, to 60 l of the thus-prepared liquor having the following composition, g/l: sodium oxide—250; alumina—100; silica—0.63; iron oxide—0.012; organic compounds—3.02; gallium—0.32 and zinc—1.6 (5-fold relative to gallium) is subjected to electrolysis using direct current under the following conditions: cathodic current density 700 $A/m^2$; voltage 3.9 V; temperature 30° C. The material of the anodes is nickel; that of the cathodes is lead.

After 4 hours of electrolysis the following metals are recovered, in percentage of their initial amounts: gallium—70; zinc—98.

The removal of the resulting electrolytic deposit and processing thereof to metallic gallium is conducted in a manner similar to that described in Example 1.

The total amount of recovered gallium is 12.7 g. The thus-produced metal contains, % by mass: gallium—94.788; zinc—5.2; lead—$1.10^{-2}$; copper—$1.10^{-3}$; aluminum—$1.10^{-3}$. No other impurities are detected. After treatment of the resulting metallic gallium with hydrochloric acid diluted with water in the volume ratio of 1:2 at the temperature of 60° C., it contains 99.988% by mass of gallium.

EXAMPLE 11

Preparation and electrolysis of liquors are effected as in Example 10, except that electrolysis is conducted at the temperature of 37° C. and at the voltage of 3.7 V. The material of the anodes is nickel; that of cathodes—steel 1X18H9T. The cathodes are cooled with water.

After 4 hours of electrolysis the following metals are recovered, in percentage of their initial amounts: gallium—65; zinc—97.

The resulting electrolytic deposit is removed from the cathodes and processed to gallium following the procedure of Example 1 hereinbefore.

The total amount of the recovered gallium is 11.9 g. The composition of the thus-produced metallic gallium is similar to that indicated in Example 1.

EXAMPLE 12

To 60 l of the mother aluminate liquor resulting from Bayer's process and having the composition specified in Example 2 zinc is added in the amount of 1.9 g/l (10-fold relative to gallium) and electrolysis is conducted using direct current under the following conditions: cathodic current density 550 $A/m^2$; voltage 4.1 V; temperature 28° C. The material of the anodes—steel 1X18N9T; the material of the cathodes—titanium.

After 4 hours of electrolysis the following metals are recovered from the liquor, in percentage of their initial amounts; gallium 51; zinc—97.

The removal of the electrolytic deposit and processing thereof to metallic gallium are performed as in Example 1.

The total amount of the recovered gallium is 5.5 g. The composition of the resulting metallic gallium is similar to that indicated in Example 1 hereinbefore.

EXAMPLE 13

10 l of the liquor prepared as in Example 10 are subjected to electrolysis using pulsating current (current switch-off interval is 0.5 sec; frequency of switching is 1 switching per minute) under the following conditions: cathodic current density is 650 $A/m^2$, voltage 3.8 V; temperature 30° C. The material of the anodes is steel 1X18H9T, that of the cathodes—nickel. The cathodes are cooled with water.

After 4 hours of electrolysis the following metals are recovered from the liquor, in percentage of their initial amounts: gallium—82; zinc—96.

The removal of the electrolytic deposit and processing thereof to metallic gallium are performed as in Example 1.

The total amount of the recovered gallium is 2.49 g. The composition of the resulting gallium is similar to that described in Example 1 hereinbefore.

EXAMPLE 14

10 l of the liquor prepared as in Example 10, are subjected to electrolysis using reversing current (time of anodic polarization is 0.2 sec; frequency of switching—4 switchings per minute). The conditions of electrolysis and materials of the electrodes are the same as in the foregoing Example 13.

After 4 hours of electrolysis the following metals are recovered from the liquor, percentage of their initial amounts gallium—75; zinc—98.

The removal of the electrolytic deposit and processing thereof to metallic gallium are conducted as in Example 1.

The total amount of the recovered gallium is 2.28 g. The resulting metal contains, % by mass: gallium—95.996; zinc—4.0; lead—$1.10^{-3}$; copper—$1.10^{-3}$; aluminium—$1.10^{-3}$; iron—$1.10^{-3}$. No other impurities are detected.

After treatment of the resulting metallic gallium with hydrochloric acid diluted with water in the volume ratio of 1:2 at the temperature of 60° C. it contains gallium in the amount of 99.996% by mass.

EXAMPLE 15

The return aluminate liquor resulting from Bayer's process having the following composition, g/l: sodium oxide—310; alumina—138; silica—0.9; iron oxide—0.019; organic compounds—3.89; sulphide sulphur—1.47; sulphite sulphur—0.92; thiosulphate sulphur—2.19; gallium—0.43 is diluted with water in the volume ratio of 1:0.32. Then to 100 l of the liquor heated to the temperature of 190° C. 609 g of zinc oxide are added under stirring, including 302 g consumed for binding sulphide sulphur in the starting liquor and 89 g—for binding secondary sulphide sulphur formed during electrolysis upon decomposition of thiosulphate sulphur. The remaining amount of zinc oxide (218 g) is consumed for electrolytic recovery of gallium.

The resulting liquor, after separation of the precipitate of zinc sulphide, has the following composition, g/l: sodium oxide—253; alumina—112; silica—0.72; iron oxide—0.008; organic compounds—3.14; thiosulphate sulphur—1.76; sulphite sulphur—0.70; gallium—0.35 and zinc—2.46. This liquor in the amount of 60 liters is subjected to electrolysis.

Said electrolysis is conducted using direct current under the following conditions: cathodic current density 400 $A/m^2$; voltage 3.8 V; temperature 35° C. The material of the anodes is nickel. That of the cathodes is steel 1X18H9T.

After 4 hours of electrolysis the following metals are recovered from the liquor, in percentage of their initial amounts: gallium—52; zinc—92. The resulting electrolytic residue is removed from the cathode and processed to metallic gallium as in Example 1.

The total amount of the recovered gallium is 10.3 g. The composition of the resulting metallic gallium is similar to that indicated in Example 1 hereinbefore.

After settling, the spent liquor purified during the electrolysis from contaminating polyvalent sulphur compounds and iron and having the following composition, g/l: sodium oxide—255; alumina—112; silica—0.72; iron oxide—0.001; organic compounds—2.90; sulphide sulphur—0.07; sulphite sulphur—0.45; thiosulphate sulphur—0.42; gallium—0.17 and zinc—0.017 is recycled to the production of alumina.

INDUSTRIAL APPLICABILITY

The process of the present invention is useful in the manufacture of gallium or gallium and vanadium for alkaline liquors resulting alumina production, which liquors contain aluminates, carbonates, silicates, vanadates, gallates, phosphates, molybdates, zincates, ferrites, chlorides, fluorides, polyvalent-sulphur compounds with alkali metals, as well as organic compounds.

Gallium and vanadium, owing to their valuable specific properties, find application in such industries as nuclear energetics, manufacturing of electronic and semiconductor instruments, rocket engineering, metallurgy, optics, and medicine.

What we claim is:

1. A process for electrolytic recovery of gallium or gallium and vanadium from alkaline liquors resulting from the production of alumina by electrolysis on solid electrodes, comprising introducing a metal into said alkaline liquor in an amount of about 1 to 10 times by weight relative to the weight of gallium in said liquor and then subjecting said alkaline liquor containing said metal to electrolysis at a cathodic current density of from about 200 to 1,000 A/m.$^2$, a voltage of from about 3.4 to 4.5 V, and a temperature of from about 28° to 37° C., wherein the metal preliminarily introduced into the alkaline liquor is effective to form upon electrolysis of said alkaline liquor, an alloy with gallium which is not passivated under the conditions of electrolysis.

2. A process according to claim 1, in which the starting alkaline liquor resulting from alumina production is selected from mother aluminate liquor from the Bayer process, return aluminate liquor from the Bayer process or a mixture thereof in a volume ratio of 0.1–1.0:1.0–0.1 of said mother liquor to said return liquor.

3. A process according to claim 2, in which the starting alkaline liquor resulting from alumina production is return aluminate liquor from the Bayer process diluted with water in a volume ratio of said liquor to said water 1.0:0.1–0.9.

4. A process according to claim 1, in which the starting alkaline liquor resulting from alumina or production is alkaline liquor prepared precipitating the return aluminate liquor from Bayer's process with soda at a concentration of soda exceeding the equilibrium value, filtering the resulting liquor and repulping the residue from the filtration with water at a temperature of about 50° to 100° C.

5. A process according to claim 1, in which the metal preliminarily introduced into the starting liquors is selected from zinc, lead and tin.

6. A process according to claim 1, in which electrolysis of said alkaline liquor resulting from alumina production is is carried out with direct current, pulsating current, reversing current, or a combination thereof.

7. A process according to claim 1, in which the electrodes used for the electrolysis of said alkaline liquor are composed of metal resistant in alkaline media selected from steel, nickel and titanium.

8. A process according to claim 7, in which the cathodes used for the electrolysis of said alkaline liquor are cooled with water.

9. A process according to claim 1, wherein polyvalent sulphur compounds are present in the starting alkaline liquor resulting from alumina production, and wherein an additional amount of metal effective to form an alloy with gallium is introduced to said alkaline liquor prior to the electrolysis thereof in a stoichiometric amount relative to the amount of polyvalent-sulphur compounds in said liquor.

10. A process according to claim 1, in which electrolysis is continued until the residual concentration of the metal preliminary introduced into the starting alkaline liquor is about 0.02–0.005 g./l.

11. A process according to claim 1 or 5 in which said metal is introduced to the alkaline liquor as metal per se, metal oxide or an inorganic metal salt which is soluble in said alkaline liquor.

12. A process according to claim 1 in which zinc is the metal introduced to said alkaline liquor prior to the electrolysis thereof.

13. The process according to claim 1 in which gallium is present in said alkaline liquor in an amount of about 0.15 to 0.5 g./liter.

14. The process of claim 1 in which the starting alkaline liquor from the production of alumina is selected from mother liquor from the Bayer process, return aluminate liquor from the Bayer process and a mixture thereof.

* * * * *